US009193146B2

(12) United States Patent
Till

(10) Patent No.: US 9,193,146 B2
(45) Date of Patent: Nov. 24, 2015

(54) MACHINE FOR PRINTING CONTAINERS

(75) Inventor: Volker Till, Hofheim am Taunus (DE)

(73) Assignee: Till GmbH, Hofheim am Taunus (DE)

( * ) Notice: Subject to any disclaimer, the term of this patent is extended or adjusted under 35 U.S.C. 154(b) by 0 days.

(21) Appl. No.: 13/977,364

(22) PCT Filed: Dec. 30, 2011

(86) PCT No.: PCT/EP2011/074289
§ 371 (c)(1),
(2), (4) Date: Jun. 28, 2013

(87) PCT Pub. No.: WO2012/093077
PCT Pub. Date: Jul. 12, 2012

(65) Prior Publication Data

US 2013/0269551 A1 Oct. 17, 2013

(30) Foreign Application Priority Data

Jan. 5, 2011 (DE) ..... 10 2011 007 979

(51) Int. Cl.
*B41J 3/407* (2006.01)
*B41F 16/00* (2006.01)
(Continued)

(52) U.S. Cl.
CPC ..... *B41F 16/0086* (2013.01); *B41F 15/0872* (2013.01); *B41F 17/30* (2013.01); *B41J 3/407* (2013.01); *B41J 3/4073* (2013.01)

(58) Field of Classification Search
CPC ..... B41J 3/4073; B41J 3/407; B41F 15/0872; B41F 17/30
USPC ..... 101/35, 36, 38.1, 39, 40, 40.1; 347/4; 198/339.1, 418, 418.1, 459.2, 478.1
See application file for complete search history.

(56) References Cited

U.S. PATENT DOCUMENTS 5,207,156 A * 5/1993 Helling ..... 101/38.1
5,317,967 A 6/1994 Heidenreich
(Continued)

FOREIGN PATENT DOCUMENTS

EP 2255971 12/2010
GB 2180195 3/1987
(Continued)

OTHER PUBLICATIONS

PCT Notification Concerning Transmittal of International Preliminary Report on Patentability, from International Application No. PCT/EP2011/074289, corresponding to U.S. Appl. No. 13/977,364, mailed Jul. 5, 2013, 5 pages.
(Continued)

*Primary Examiner* — Blake A Tankersley
*Assistant Examiner* — Marissa Ferguson Samreth
(74) *Attorney, Agent, or Firm* — Pauly, Devries Smith & Deffner, LLC

(57) ABSTRACT

Described is a machine for printing containers such as bottles or cans, with a plurality of treatment stations, on which printing heads and if applicable further devices required for the pre-treatment and post-treatment of the containers are provided, with a carrier for a plurality of containers, which are arranged next to one another on the carrier. In the process it is provided that the carrier can be transported via a conveyor belt from one treatment station to the next, in that a plurality of treatment stations each are arranged in line next to one another substantially transversely to the conveyor belt, in that the carrier is arranged substantially transversely to the conveyor belt and in that the treatment stations and the carrier can be moved relative to one another in substantially vertical direction. Instead of the conveyor belt, a rotary device can also be provided.

20 Claims, 5 Drawing Sheets

(51) Int. Cl.
*B41F 15/08* (2006.01)
*B41F 17/30* (2006.01)

(56) References Cited

U.S. PATENT DOCUMENTS 5,377,815 A * 1/1995 Vetter et al. ..... 198/476.1
5,591,470 A * 1/1997 Bartley ..... 426/391
5,784,171 A 7/1998 Kano
5,815,282 A 9/1998 Kano
6,135,654 A * 10/2000 Jennel ..... 400/61
6,164,199 A * 12/2000 Dubuit et al. ..... 101/38.1
6,948,425 B2 * 9/2005 Dumenil ..... 101/38.1
7,168,366 B2 * 1/2007 Louviere et al. ..... 101/35
7,625,059 B2 * 12/2009 Uptergrove ..... 347/16
8,070,244 B2 * 12/2011 Dumenil ..... 347/2
2011/0038702 A1 * 2/2011 Torsten ..... 414/795.2
2011/0179959 A1 7/2011 Gerigk et al.
2011/0232514 A1 9/2011 Putzer et al.

FOREIGN PATENT DOCUMENTS

WO 2004009360 1/2004
WO 2006069261 6/2006
WO 2011147485 12/2011

OTHER PUBLICATIONS

PCT International Search Report from International Application No. PCT/EP2011/074289, corresponding to U.S. Appl. No. 13/977,364, mailed Jul. 12, 2012, 3 pages.

* cited by examiner

MACHINE FOR PRINTING CONTAINERS

CROSS-REFERENCE TO RELATED APPLICATIONS

This application is a national stage application under 35 U.S.C. 317 of International Patent Application Serial No. PCT/EP2011/074289, entitled "Maschine Zum Bedrucken Von Behältern," filed Dec. 30, 2011, which claims priority from German Patent Application No. DE 10 2011 007 979.3, filed Jan. 5, 2011, the disclosures of which are incorporated herein by reference.

FIELD OF THE INVENTION

The invention relates to a machine for printing containers such as bottles made of glass or plastic or cans, with a plurality of treatment stations, on which printing heads and, if applicable, further devices necessary for pre-treatment and after-treatment of the containers are provided, and with a carrier for a plurality of containers, which are arranged next to one another on the carrier.

BACKGROUND

Containers such as bottles and packages are usually provided with labels so that consumer information can be attached. It is also known to apply markings or other information to the package using inkjet printers in order to make possible individualisations which label printing does not permit. Such printing systems work in monochrome and are restricted to few printing dots per lines.

In order to apply a polychrome print directly onto containers, a plurality of printing heads which operate in monochrome according to the inkjet principle are arranged one after the other and suitably offset so that depending on the number of the colours an always equal spacing between the individual printing dots is achieved. This is possible with an adjustment on a machine having a plurality of printing heads arranged one after the other in a defined manner. The packaging material and the printing heads in this case are moving relatively to each other with a constant speed. The output of such a machine is therefore dependent on the printing speed of a respective printing head. Although this is practicable for absorbent packaging materials, the ink, by contrast, with other materials such as metals, glass or plastic, has to be dried through heat or cured through cross-linking by means of UV or electron beams. This process has to be applied also between the printing of successive printing colours at least as so-called pinning, a "part curing", which increases the length of such machines.

In the device described in DE 10 2008 049 241 A1 for applying a polychrome print image on a container, a plurality of modules are connected one after the other, in which different treatment steps such as pre-treatment, printing, drying and checking are carried out. The containers are transferred from one module to the next so that in each case a new positioning and adjustment is required. This impairs the accuracy of the print image and reduces the throughput speed.

From WO 2004/009360 A1 a device is known, in which the containers during printing are each arranged on a mandrel serving as container carrier. With a plurality of printing heads distributed about the mandrel, a colour image consisting of a plurality of colour sets is applied to the container while the mandrel is rotated. The mandrels are provided on a revolving driven transport element, with which the container during printing are moved on a transport section formed between a container inlet and a container outlet.

Industrial utilisation of these plants is to take place at high outputs, for example in bottle filling plants with up to 36,000 bottles per hour. Here, the bottles and thus also the printing head are transported on a rotating machine with a speed of approximately 1.5 m/s, so that the ink drops can be exposed to an airflow which can impair the print quality.

It is therefore the object of the present invention to increase the print quality during the printing of containers with high printing output and reliable function.

SUMMARY

With a machine of the type mentioned at the outset, this object is substantially solved with the invention in that the carrier can be transported from one treatment station to the next via a conveyor belt, in that a plurality of treatment stations each are substantially arranged in series next to one another transversely to the conveyor belt, in that the carrier is substantially arranged transversely to the conveyor belt and in that the treatment station and the carrier can be moved in substantially vertical direction relative to one another.

The machine according to the invention operates by in-line indexing and always treats a plurality of containers simultaneously. Since with an in-line machine other than with the rotary machines described above the containers and the printing heads during printing do not rotate around the center of the machine, the headwind impairing the print quality does not apply, so that a more accurate print image can be achieved.

In an alternative embodiment, the machine operates as a rotary indexing machine, wherein the carrier via a rotary device can be transported from one treatment station to the next, while it rotates around a central axis. A plurality of treatment stations are each arranged in line next to one another substantially radially to the rotary centre. The carrier, too, is substantially arranged radially to the rotary device. The treatment stations and the carrier can be moved relative to one another in substantially vertical direction.

Thus, both versions operate according to the same principle, in which a plurality of containers are arranged next to one another on the carrier and are transported in groups from one treatment station to the next.

In an embodiment, the transverse carriers can be lifted off the conveyor belt towards the top so that the containers mounted on the transverse carriers can be moved into the treatment stations from the bottom.

According to the invention, a plurality, in particular 4 to 7 printing heads are arranged annularly about the container in a treatment station and are attached to a retaining plate orientated annularly with respect to one another. Thus, a rapid change of printing heads with a new retaining plate is made possible and the adjustment of the printing heads relative to one another on the retaining plate can be carried out on a test stand independently of the machine. The maintenance times of the machine can be correspondingly reduced.

According to a further development of the invention, turntables for receiving the containers are provided on the carrier, so that the containers can be rotated about the centre of the printing heads which are annularly provided about these. The printing heads themselves are stationary during printing, as a result of which the print quality is further increased.

To prevent the containers falling over during the transport, these are held on the turntables through low pressure or vacuum. Alternatively, clamping is possible but which for example in the case of PET-bottles can result in undesirable deformations because of the required pressure.

Exact positioning of the containers according to the invention is achieved through a rotatable centring device, which can be placed onto the container holding it through its own weight.

As a further development of the this inventive idea, centring devices with rotary drives assigned to the containers are provided on the treatment stations above the carrier, which on lifting the carrier are lifted along their longitudinal axis through the containers arranged on said carrier. Because of the supported weight, the rotation of the drive is reliably transmitted onto the container so that its circumference can be guided passed the printing heads in a defined manner.

Following the printing, the ink is usually cured through UV-rays or by means of electron beam guns. When using electron beam guns, cheap ink can be employed because of the improved cross-linking. However, x-rays, for example are generated in the process which must not be passed on to the surroundings. According to the invention, an for example lead-insulated cover that is closed on all sides and only open towards the bottom is therefore provided on the treatment station intended for the retreatment, which through the lifting of the carrier can be closed off either through the carrier itself or through the turntable. When the transverse carrier with the containers is lifted, the box is sealed off tightly from below, so that the UV or e-beam treatment can be carried out without the undesirable radiation escaping.

In order to ensure a defined positioning during printing, the transverse carrier according to the invention is alternatively and/or additionally for pressing on for example through the lifting cylinder is centred relative to the treatment station and/or additionally mechanically braced. In a particularly simple manner, this can be effected by means of an eccentric clamp, but also pneumatically, hydraulically or magnetically. By bracing the transverse carrier, all containers arranged on the latter are simultaneously positioned in their respective treatment stations.

The capacity of the machine can be further increased in that a plurality, at least two to four rows of the same type of treatment stations are arranged one behind the other and the indexing of the machine correspondingly transports each of the transverse carriers covered by two to four steps.

In order to further reduce shocks during printing, the treatment stations can be fastened to the floor separately from the transport system. Thus, the transport movements when inserting new containers and removing the finish-printed containers are not transmitted to the treatment station.

According to the invention, stations for filling and closing the containers can be connected downstream of the treatment stations for preparing the printing, the printing operation and the ink curing. The existing container mounting, the centring device of the containers, the transport device, the charge and discharge are thus not needed a second time and a cost-effective system with multiple use is achieved.

In one embodiment, the invention provides a machine for printing containers such as bottles or cans, with a plurality of treatment stations, on which printing heads and if applicable further devices required for the pre-treatment and post-treatment of the containers are provided, with a carrier for a plurality of containers, which are arranged on the carrier next to one another, wherein the carrier can be transported via a conveyor belt from one treatment station to the next, in that in each case a plurality of treatment stations are arranged in series next to one another substantially transversely to the conveyor belt, in that the carrier is substantially arranged transversely to the conveyor belt and in that the treatment stations and the carrier can be moved relative to one another substantially in vertical direction.

In an embodiment the invention provides a machine for printing containers such as bottles or cans, with a plurality of treatment stations, on which printing heads and if applicable further devices required for the pre-treatment and post-treatment of the containers are provided, with a carrier for a plurality of containers, which are arranged on the carrier next to one another, wherein the carrier can be transported from one treatment station to the next via a rotary device, wherein it rotates about a rotary centre, in that in each case a plurality of treatment stations are arranged in series next to one another substantially radially to the rotary centre, in that the carrier is substantially arranged radially to the rotary centre and in that the treatment stations and the carrier can be moved relative to one another in the substantially vertical direction.

In an embodiment, the carrier can be lifted off the conveyor belt or the rotary device towards the top.

In an embodiment, a plurality of printing heads are arranged annularly about the container in a treatment station.

In an embodiment, the printing heads are attached to a retaining plate annularly aligned with respect to one another.

In an embodiment, on the carrier turntables for receiving the containers the containers are held on the turntables through low pressure or vacuum.

In an embodiment, along the machine a fixed low pressure or vacuum channel or a plurality of fixed low pressure or vacuum channels is/are arranged from which the low pressure or vacuum for attracting the containers by suction is fed.

In an embodiment, the carrier with the turntables for receiving the containers is embodied hollow and a low pressure or vacuum by way of laterally arranged end plates running in guides of the low pressure or vacuum channel is transmitted from the one fixed low pressure or vacuum channel or the plurality of fixed low pressure or vacuum channels to the carrier.

In an embodiment, a centring device is placed onto the container.

In an embodiment, above the carrier on the treatment stations motors or rotary drives assigned to the containers are provided, which on lifting the carrier are lifted off through the containers arranged on said carrier along their longitudinal axis, centre the containers through their own weight and thus also transmit the rotary drive force onto the container.

In an embodiment, at least one row of treatment stations comprises one or a plurality of cover/s, which can be closed off through the turntables if required.

In an embodiment, at least one row or a plurality of rows of treatment stations have a common cover, which can be closed off through the carrier or carriers.

In an embodiment, the carrier can be mechanically braced against the treatment station.

In an embodiment, a plurality of the same type of treatment stations are arranged one after the other.

In an embodiment, the treatment stations are fastened to the floor separately from the transport system.

In an embodiment, four to seven printing heads are arranged annularly about the container in a treatment station.

In an embodiment, the centring device can be lifted off, lowered and/or rotated and if required driven by means of a motor or rotary drive.

In an embodiment, the carrier can be mechanically braced against the treatment station through an eccentric clamp.

In an embodiment, two to four rows of the same type of treatment stations are arranged one after the other.

BRIEF DESCRIPTION OF THE FIGURES

Further developments, advantages and application possibilities of the invention are obtained from the following description of exemplary embodiments and the drawing.

Here, all features described and/or depicted form subject of the invention by themselves or in any combination regardless of their combination in the claims or their reference.

DETAILED DESCRIPTION

Figure 1:
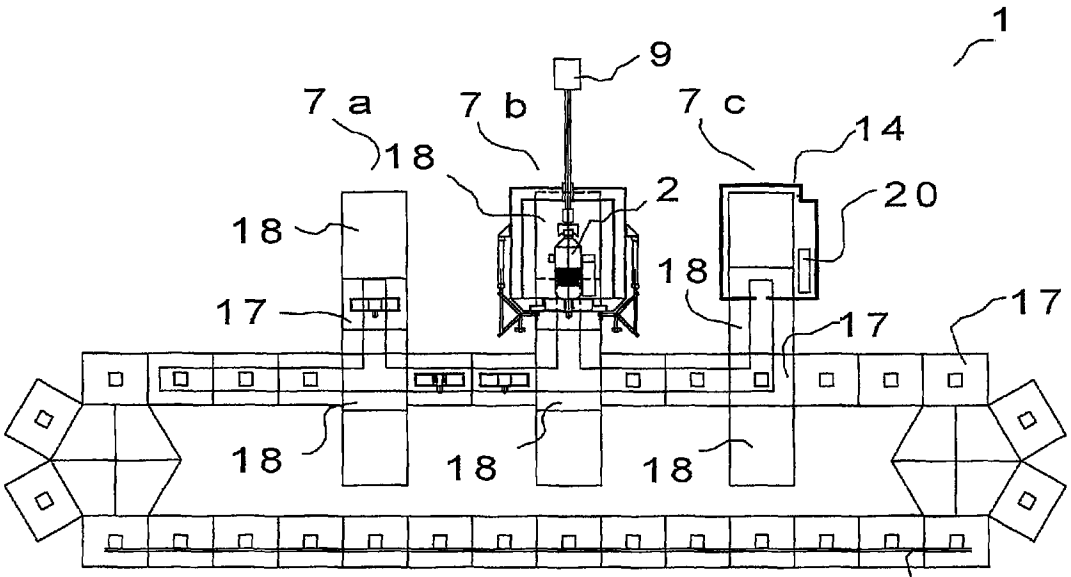
FIG. 1 is a lateral view of a machine according to the invention according to a first embodiment operating by in-line indexing, FIG. 2. is a top view of the in-line machine with only partly represented transverse carriers.
Figure 2:
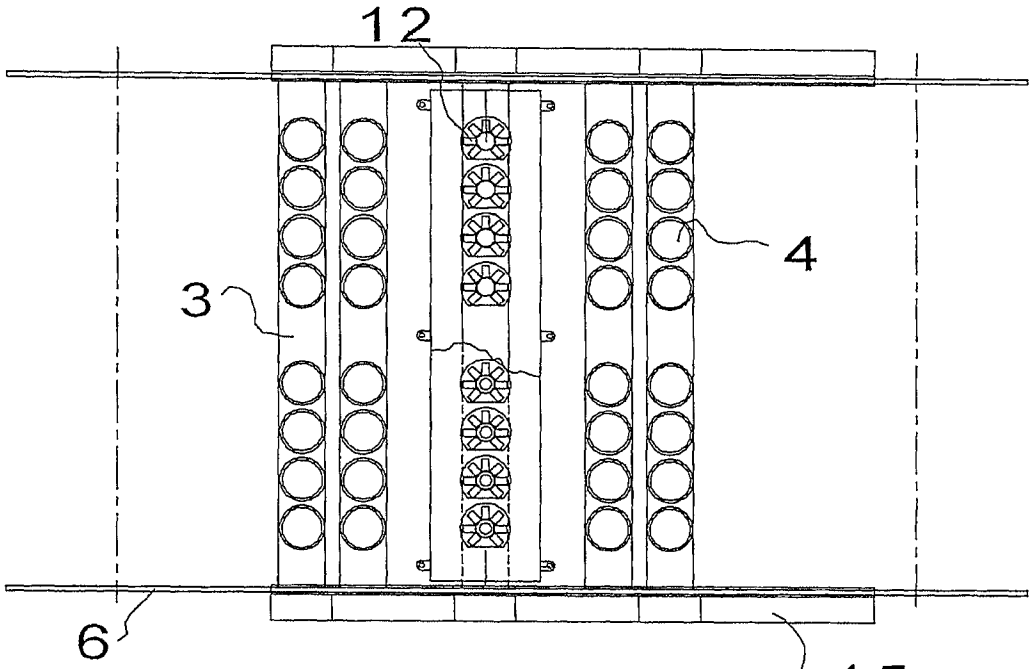
Figure 3A:
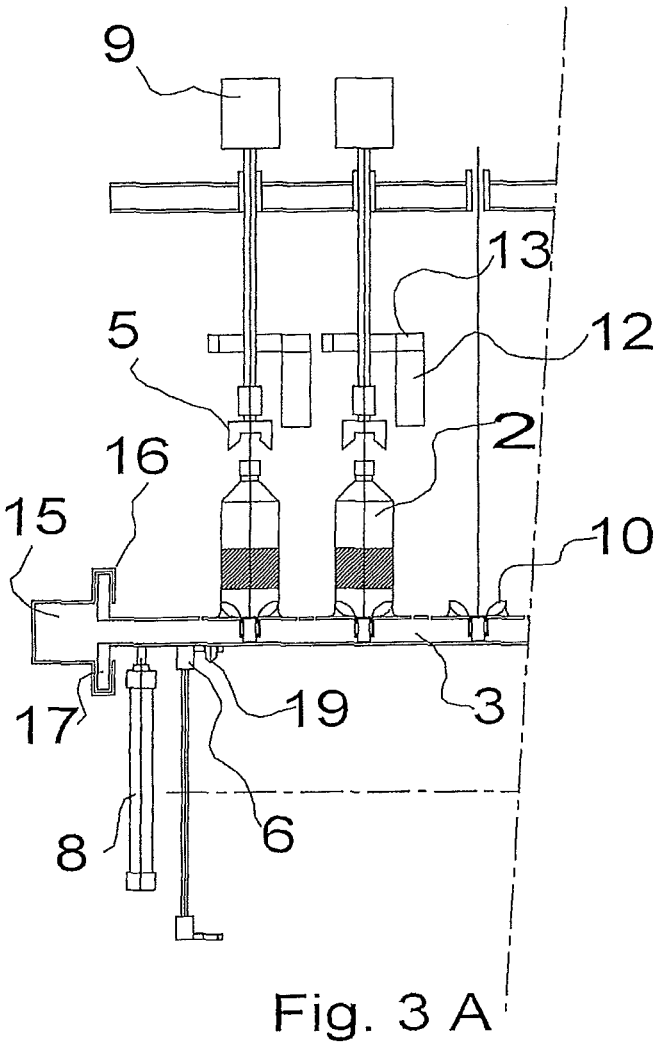
FIG. 3A and 3B show a part of a section of the machine with a lowered or a lifted carrier.
Figure 3B:
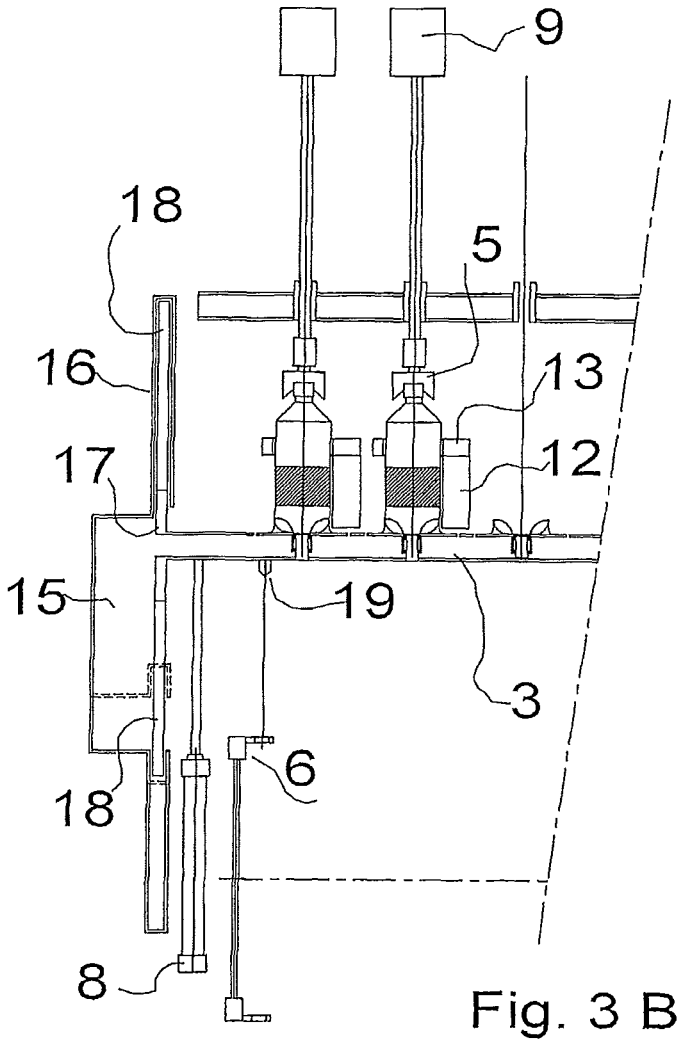

In the in-line machine 1 schematically shown in FIGS. 1 and 2 for the printing of containers 2 such as bottles made from glass or plastic, cans or the like, a plurality of containers 2 here represented in the form of bottles are arranged next to one another on a carrier (transverse carrier) 3 configured as transport beam in series and treated in parallel.

Each transverse carrier 3 has a defined quantity, such as eight or twelve, turntables 4 which are each rotatable about an axis. The containers 2 are held on the turntables 4 through low pressure or vacuum. To this end, suction holes which are not shown are provided in the turntables 4, through which suction is carried out. The low pressure or vacuum extraction is effected centrally, for example through a low pressure or vacuum channel 15 along one or both sides of the machine 1. Here, the low pressure or vacuum channel 15 has three drives 16, in which lateral end plates 17 of the transverse carriers 3 slide, in order to avoid additional hoses during the longitudinal transport as well as the lifting movement. The low pressure or vacuum channels 15 are sealed towards the lateral end plates 17 of the transverse carriers 3 like the turntables 4 for example by way of brush strips or seals. During the lifting movement, slides 18, which close off the gaps created through the lift, run above and below the end plates 17. The stability of the containers 2 on the turntables 4 can be further improved in that the turntables 4 are adapted to the bottom contour of the bottle by means of exchangeable format parts 10. When the container 2 is placed on the turntable 4, the turntable 4 is then rotated with a low torque so that the container contour can engage in the negative form of the format part 10 on the turntable 4, thereby stopping for example the rotation.

The transverse carriers 3 are transported through the machine 1 to the individual treatment stations 7 via a conveyor belt 6, in which the transverse carriers 3 engage by way of centring pins 19 or the like. The conveyor belt 6 is moved cyclically. Thus, eight containers 2 for example can be pushed onto the individual turntables 4 on a first station and fixed through the low pressure or vacuum from the lateral low pressure or vacuum channels 15.

The transverse carriers 3 with their fixed containers 2 are cyclically moved on through the conveyor belt 6. Thus they reach a first treatment station 7, in which the transverse carrier 3 with all centred and thus fixed containers 2 is lifted off the conveyor belts 6. The lifting of the transverse carriers 3 is effected via pneumatic cylinders 8. Alternatively, the transverse carriers 3 can remain on the conveyor belt 6 and the treatment stations 7 are correspondingly lowered and subsequently lifted off again.

Above the turntables 4, centring devices 5 are provided on the treatment stations 7 in order for the containers 2 to perpendicularly align their axis. These centring devices are driven through rotary drives or motors 9, for example servomotors or stepping motors and transmit the rotary movement onto the containers 2 via the centring device 5. Here, the fact that the containers 2 lift the centring device 5 and the motors 9 through the lifting movement and their own weight generates the necessary friction or positive connection in order to transmit the necessary torque is utilised. If applicable, the weight is supported through a further force.

The transverse carriers 3 are fixed in their upper position through a plurality of electromagnets or mechanical locking devices, for example an eccentric clamp in order to prevent vibrations and possible bending-through. Here, the container centring devices 5 can be alternatively also lifted by their top side into a coupling which is not shown, which is connected to a rotary drive 9 for each station.

In the machine 1, the transverse carriers 3 with the containers 2 are initially transported to a pre-treatment station 7*a* and following lifting into the station, treated by a plasma beam on its surface to be printed in order to dissolve greases or for example to activate the surface. In this station, the containers can be centred through the centring device 5 and rotated.

Following the plasma treatment, the containers 2 together with the transverse carrier 3 are lowered into the transverse carrier centring device on the conveyor belt 6 and transported onto the printing station 7*b*. There, the transverse carriers 3 with the containers 2 are lifted again and in the process guided into the container centring devices 5, each of which is connected to a rotary drive or motor 9 embodied as servomotor or stepping motor. The containers 2 are now rotated and printing commences as soon as a constant rotational speed is reached, on all printing heads 12 of a station 7*b* simultaneously. Each container 2 is printed in a separate printing station 7*b*, whose printing heads 12 to this end are arranged circularly on a retaining blade 13 on a diameter, which corresponds to the maximum diameter of the container 2 plus a predefined distance (see FIG. 2). In the case of non-cylindrical containers 2, the arrangement of the printing heads 12 is adapted to the contour of the containers 2. The container 2 is fed in below the retaining blade 13 of the printing heads 12 and through a simple lifting device 8, lifted so far that the container 2 with its surface to be printed is positioned in the ring of the printing heads 12. If a wider printing surface than that of the printing head width is desired, lifting, instead through pneumatic cylinders 8, is performed through a servo axis, which is able to bring the container into a second lifting position such that a continuation of the print can take place seamlessly. The retaining blades 13 with the printing heads 12 are configured detachable towards the bottom with respect to their fixing, without the orientation of the heads 12 among one another being lost. Thus, the printing heads 12 can be rapidly changed by attaching a new retaining blade 13, wherein the adjustment of the annularly arranged printing heads 12 among themselves on the retaining blade 13 can be carried out on a test stand which is not shown, independently of the machine 1.

After the end of the rotation (upon a single print following a rotation, in the case of a print of a higher resolution, after two rotations, wherein an offset is then generated after the first rotation, so that between the printing dots of the first rotation the following printing dots can be applied) the transverse carriers 3 with the containers 2 are again lowered and transported on to the next (retreatment) station 7*c*. There, they are again lifted and, through coupling the container centring device to a respective rotary drive 9, rotated again. In the process, the container 2 this time moves into a cover 14, which is closed on all sides and only open towards the bottom. The cover can be embodied either individually per station or as a box over approximately the length and width of the carrier. The downwardly directly opening is either sealed through the turntable 4 of the carrier 3, in that the turntable 4 or the carrier 3 at the end of the lifting operation contacts there or moves into a labyrinth seal. At this station 7*c*, the ink is cured by means of UV-beams 20 or electron beams 20, or part-hardened (pinned) if other colours to be printed, follow. Thus, by forming the cover 14, no rays can escape any longer and a container treatment that is safe for the surroundings can take place. Alternatively, a common drive for the rotation can be installed on this station for all containers, which for example via a belt drive, drives all container centring devices 5. At the end of the curing operation, the carrier 3 with the containers 2 is again lowered and moved to the last station, the output station, from which it leaves the plant.

Provided in a rail 11, the empty transverse carriers 3 are again moved to the start by way of the return end of the transport device. Through the guiding in the rail 11, the transverse carriers 3 cannot fall out of their centring device.

The treatment stations 7 are supported on the floor separately from the transport device 6 in order to avoid that vibrations caused through mechanical operations other than the printing itself are transmitted onto the printing heads 12.

In a simple manner, the invention ensures an optimal print image without being influenced by tolerances. To this end, the print is carried out for example with up to seven colours in a single station 7*b* and in a single position at a time, at which no mechanical transports or movements except for the container rotation take place and printing thus takes place in complete state of rest. Part curing (pinning) can also take place in this position.

With an alternative embodiment, two to four rows of the respective carriers 3 are arranged one after the other and the conveyor belt 6 moved in steps of 2, 3 or 4 in order to achieve a correspondingly higher output.

It is also possible to move to a plurality of printing stations one after the other and provide a row for intermediate curing each in between. The turntable 4 of the container 2 on the transverse carrier 3 is provided with an angle encoding for this purpose, so that the zero point can be clearly identified. The following treatment sequence is then obtained:

surface activation for example through plasma
printing of colour set 1
curing of colour set 1
printing of colour set 2
curing of colour set 2

According to the invention, additional stations for filling and closing the containers can then be connected within the same machine 1 downstream of the treatment stations 7 for preparation of the print, the printing process and the ink curing. Thus, the existing container mounting, the centring of the containers, the transport device, the charging and discharging are not necessary a second time and a cost-effective system with multiple use is achieved.

Figure 4:
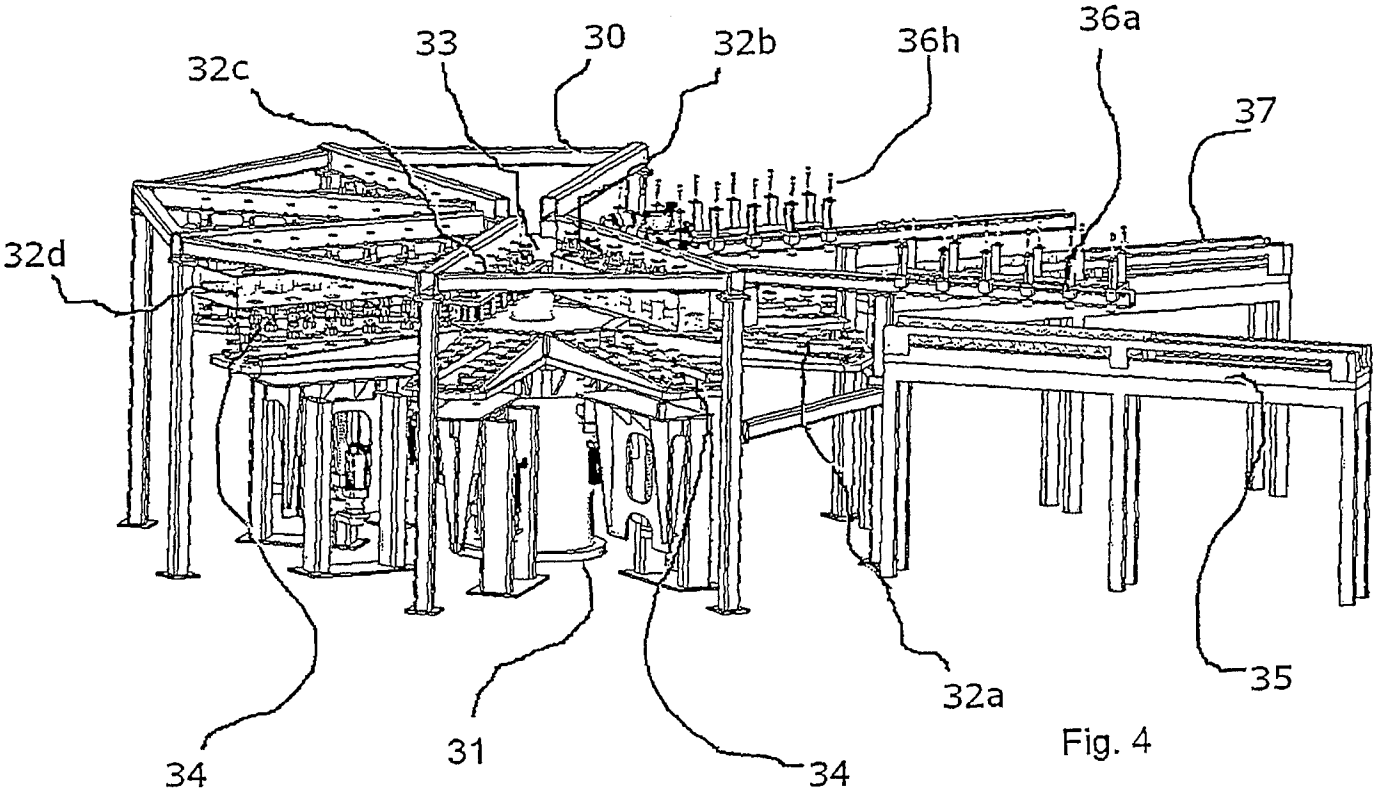
FIG. 4 is a perspective view of a machine according to the invention according to a second embodiment operating by rotary indexing.

In the second embodiment shown in FIG. 4, the machine 30 operates according to the rotary indexing system, wherein a plurality of treatment stations 32 are arranged star-like about a rotary centre 31.

A rotary device 33 comprises a plurality of carrier 34, which are arranged below the treatment station 33 likewise star-like about the rotary centre 31.

On a charging station 32*a*, a plurality of containers 2 arranged on a feed belt 35 or the like are gripped through a radially extendable gripping device 36*a* and lowered onto a carrier 34, on which the containers 2 are held in the same manner as with the first embodiment described above. Following this, the carriers 34 are rotated by means of the rotary device 33 and positioned under the next treatment station 32*b*. On the latter, a treatment similar to the pre-treatment 7*a* with the first embodiment takes place. Following this, the containers 2 with the carrier 34 are shifted rotatingly to the next treatment station 32*c* and following the treatment there to further treatments stations 32*d* to 32*g* before they are radially lifted out of the machine again via a gripping device 36*h* on a removal station 32*h*, which is constructed similar to the charging station 32*a* and lowered onto a removal belt 37. The treatment holding of the containers in the individual treatment stations in the case of the rotary indexing machine 30 takes place in the same manner as was explained above to the in-line indexing machine 1. The difference between the embodiments substantially consists in the manner of the transport between the individual treatment stations.

The advantage of the machines 1, 30 according to the invention over the conventional rotary machines consists in the higher utilisation of the printing heads 12, since all printing heads 12 except during the container replacement do not have any waiting time. In the case of the in-line indexing machine, the machine 1 additionally becomes smaller since there are no "empty surfaces" in the middle of the carousel/s.

Through stationary printing heads 12, no centrifugal force influencing the print quality develops and any stationary ink supply can be used. Special rotary lead-throughs are obsolete. A further advantage is the printing in the stationary state. Thus, no vibrations through the operation can materialise which can influence the print image.

LIST OF REFERENCE NUMBERS

1 Machine (in-line indexing)
2 Container
3 Transverse carrier
4 Turntable
5 Centring device
6 Conveyor belt
7 Treatment station
7*a* Pre-treatment
7*b* Printing station
7*c* Post-treatment
8 Lifting cylinder
9 Rotary drive
10 Format part
11 Rail
12 Printing head
13 Retaining plate
14 Cover
15 Low pressure or Vacuum channel
16 Guide
17 End plate
18 Slide
19 Centring pin
20 UV radiator or e-beam
30 Machine (rotary indexing)
31 Rotary centre
32 Treatment station
32*a* Charging station
32*b-g* Treatment station
32*h* Removal station
33 Rotary device
34 Carrier
35 Feed belt
36*a,h* Gripping device
37 Removal belt

The invention claimed is:

1. A machine for printing containers such as bottles or cans, the machine comprising:

a conveyor belt, a plurality of treatment stations, the plurality of treatment stations are arranged in series next to one another substantially transversely to the conveyor belt, wherein at least one of the plurality of treatment stations comprise a plurality of printing heads, a carrier substantially arranged transversely to the conveyor belt, wherein the plurality of containers are arranged on the carrier and the carrier can be transported via the conveyor belt from one of the treatment stations to another of the treatment stations, a lifting device, wherein the lifting device raises the carrier with the containers in a vertical direction off the conveyor belt toward a top of each of the treatment stations when the carrier is in the treatment station.

2. The machine according to claim 1, wherein the plurality of printing heads are arranged annularly about the containers.

3. The machine according to claim 2, wherein the printing heads are attached to a retaining plate annularly and are aligned with respect to one another.

4. The machine according to claim 2, wherein the plurality of printing heads comprise four to seven printing heads arranged annularly about each container in each treatment station.

5. The machine according to claim 1, further comprising turntables provided on the carrier for receiving the containers, the containers being held on the turntables through low pressure or vacuum.

6. The machine according to claim 5, wherein the carrier is hollow and further comprises laterally arranged end plates running in guides and connected to the at least one low pressure or vacuum channel such that the low pressure or vacuum can be supplied to the turntables on the carrier.

7. The machine according to claim 1, further comprising at least one fixed low pressure or vacuum channel for providing the low pressure or vacuum for holding the containers on the turntables.

8. The machine according to claim 1, further comprising a centering device, being placed onto each of the containers.

9. The machine according to claim 8, wherein the centring device is configured to be lifted off, lowered, rotated and or driven by means of a motor or rotary drive.

10. The machine according to claim 1, further comprising centering devices with motors or rotary drives being assigned to the containers, which are configured to be lifted along their longitudinal axis by the containers arranged on the carrier when the carrier is lifted.

11. The machine according to claim 1, the plurality of treatment stations are arranged in at least one row, the at least one row further comprises one or a plurality of cover/s which can be closed off if required.

12. The machine according to claim 1, the plurality of treatment stations are arranged in at least one row, the at least one row further comprises a common cover which can be closed off through the carrier.

13. The machine according to claim 1, wherein the carrier can be mechanically braced against each treatment station.

14. The machine according to claim 13, wherein the carrier can be mechanically braced against each treatment station through an eccentric clamp.

15. The machine according to claim 1, wherein the plurality of treatment stations comprise a same type of treatment stations.

16. The machine according to claim 1, wherein the treatment stations are fastened to a floor separately from the carrier.

17. The machine according to claim 1, wherein the plurality of treatment stations are arranged in two to four rows, one after the other, and each treatment station is of the same type.

18. The machine for printing containers according to claim 1, wherein the plurality of treatment stations include a pre-treatment device and a post-treatment device.

19. A machine for printing containers such as bottles or cans, the machine comprising:

a rotary device rotating about a rotary center, a plurality of treatment stations, the plurality of treatment stations are arranged in series next to one another substantially radially to the rotary center, wherein at least one of the plurality of treatment stations comprises a plurality of printing heads, a carrier substantially arranged radially to the rotary center, wherein a plurality of containers are arranged on the carrier and the carrier can be transported from one of the treatment stations to another of the treatment stations with the rotary device, a lifting device, wherein the lifting device raises the carrier with the containers in a vertical condition off the rotary device toward a top of each of the treatment stations when the carrier is in the treatment station.

20. The machine for printing containers according to claim 19, wherein the plurality of treatment stations include a pre-treatment and a post-treatment of the device.

* * * * *